United States Patent [19]

Robb et al.

[11] 3,941,506

[45] Mar. 2, 1976

[54] ROTOR ASSEMBLY

[75] Inventors: Raymond R. Robb, Latrobe; Vijay K. Sood, Murrysville, both of Pa.

[73] Assignee: Carrier Corporation, Syracuse, N.Y.

[22] Filed: Sept. 5, 1974

[21] Appl. No.: 503,401

[52] U.S. Cl. ..... 416/244 A; 416/198 A; 403/356

[51] Int. Cl.[2] ..... F01D 5/06

[58] Field of Search ..... 416/244 A, 244, 199, 200, 416/200 A, 198 A; 403/260, 356, 358

[56] References Cited

UNITED STATES PATENTS

| | | | |
|---|---|---|---|
| 826,944 | 7/1906 | Krieger | 403/333 X |
| 1,448,925 | 3/1923 | Fulton et al. | 403/356 |
| 2,469,125 | 5/1949 | Meisser | 416/244 A UX |
| 2,660,399 | 11/1953 | Robinson et al. | 416/244 A X |
| 2,811,339 | 10/1957 | Osborne et al. | 416/200 |
| 2,843,311 | 7/1958 | Buchi | 416/244 A X |
| 3,521,349 | 7/1970 | Gehring | 29/526 |
| 3,526,467 | 9/1970 | Kime | 416/200 |
| 3,601,501 | 8/1971 | Anderson et al. | 416/244 A |
| 3,680,979 | 8/1972 | Hansen et al. | 416/198 |

FOREIGN PATENTS OR APPLICATIONS

| | | | |
|---|---|---|---|
| 770,003 | 3/1957 | United Kingdom | 416/244 A |
| 700,004 | 3/1957 | United Kingdom | 416/244 A |
| 829,977 | 3/1960 | United Kingdom | 416/244 |
| 269,605 | 10/1950 | Switzerland | 416/244 A |

*Primary Examiner*—Everette A. Powell, Jr.
*Attorney, Agent, or Firm*—J. Raymond Curtin; Thomas J. Wall

[57] ABSTRACT

An impeller and shaft assembly suitable for use in an overhung compressor for facilitating mounting and rearranging impellers upon a shaft. A stud is threaded into the end of the shaft and the impeller slidably mounted thereon. An elongated key is inserted between the stud, the shaft, and the impeller to cojoin the three elements. In another embodiment, a second impeller is mounted upon the stud adjacent the first impeller with the two impellers being locked to the stud by a common key.

6 Claims, 1 Drawing Figure

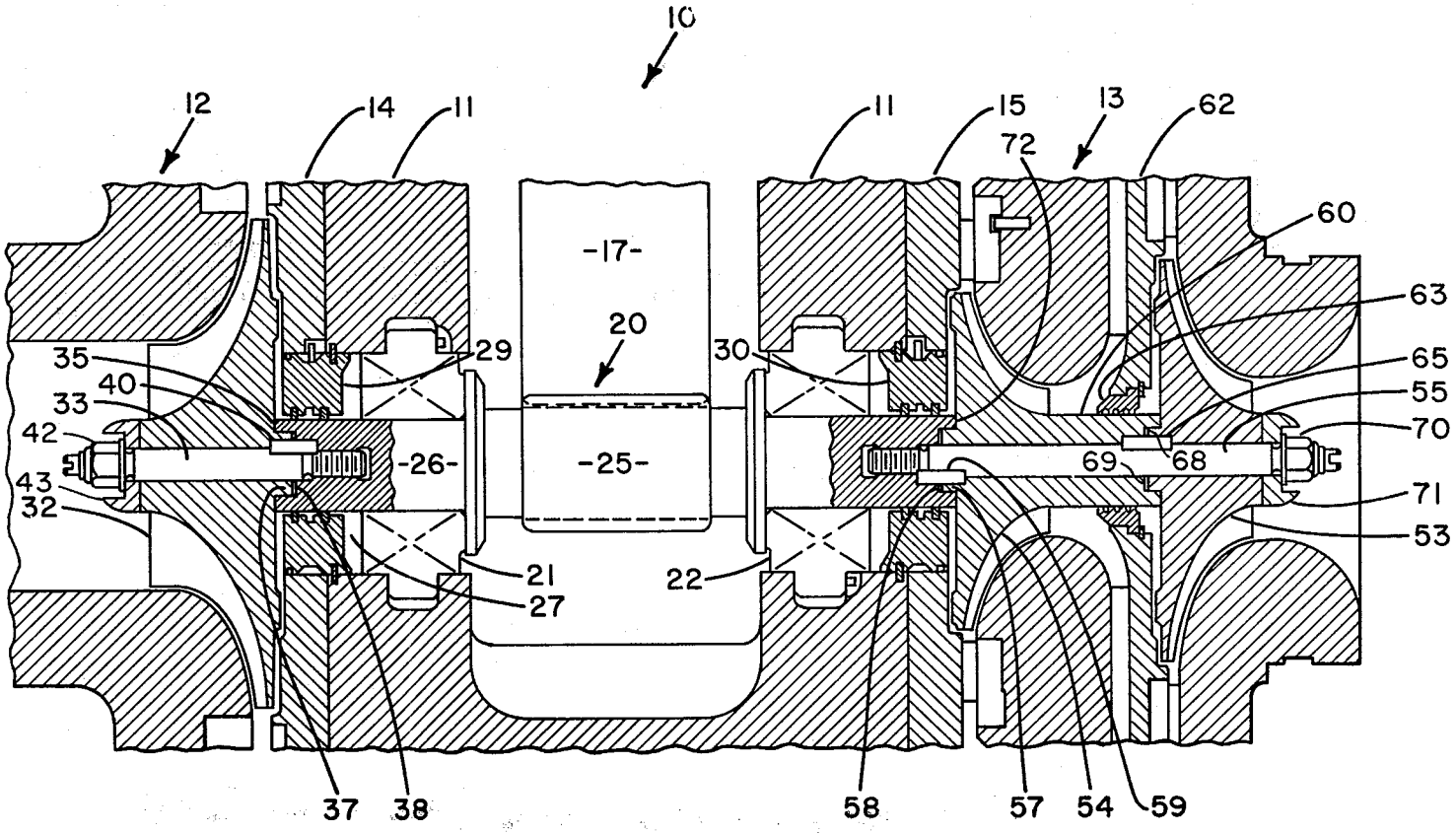
10
11
12
13
14
15
17
20
21
22
25
26
27
29
30
32
33
35
37
38
40
42
43
53
54
55
57
58
59
60
62
63
65
68
69
70
71
72

ROTOR ASSEMBLY

BACKGROUND OF THE INVENTION

This invention relates to a rotor assembly and, in particular, to an impeller drive shaft arrangement wherein the number and order of impellers mounted upon a single drive shaft can be arranged or rearranged without having to remove the shaft from its support structure. More specifically, this invention relates to an impeller mounting arrangement for use in a centrifugal compressor for providing wide flexibility in compressor staging whereby a number of different flow ranges can be attained utilizing a common base frame machine configuration.

Compressors, particularly those operating in a flow ranges between 700 and 3000 cfm, are being called upon by industry to perform an increasing number of tasks. As a result, the trend in this type of compressor has been towards "packaged" units capable of being modified to meet specific application requirements. One approach has been to package the rotor and coacting stationary compressor components in a cartridge. The cartridge is receivable in a base frame containing common machine components such as the intercoolers, oil supply, drives, controls and the like. This concept is disclosed in U.S. Pat. No. 3,802,795. Although the cartridge approach provides for some commonality in the base frame parts, it nevertheless requires that a new and relatively different cartridge be employed for each flow range serviced.

In order to overcome some of the disadvantages found in the cartridge concept, a modular approach has been developed providing for greater commonality between interchangeable parts. The apparatus of the present invention plays an important part in this modular approach in that it permits the compressor impellers to be interchangeably supported upon an impeller drive shaft that is carried within a common base frame. Impeller mounting is accomplished in a manner wherein the drive shaft does not have to be removed from its support journals or otherwise decoupled from the machine drive.

SUMMARY OF THE INVENTION

It is therefore an object of the present invention to improve centrifugal compressors and, in particular, packaged compressors capable of delivering flows of between 700 and 3000 cfm.

Another object of the present invention is to provide an impeller mounting mechanism whereby the number and order of impellers mounted upon a common drive shaft can be readily changed.

A still further object of the present invention is to improve a base frame compressor by providing means for mounting a series of impellers in various predetermined orders upon a common drive shaft without having to remove the drive shaft from the base frame structure.

These and other objects of the present invention are attained by means of an impeller and drive shaft assembly including a drive shaft journaled for rotation within a drive frame housing, a stud having a male thread receivable in at least one end of the shaft for supporting the stud in axial alignment with the shaft, an impeller mounted upon the stud, and a key insertable between the drive shaft and the stud and being arranged to engage the impeller whereby the shaft, the stud, and the impeller rotate in unison as the shaft is turned, and means for preventing the impeller from moving axially upon the stud. In another embodiment of the invention, a second impeller is mounted upon the stud in tandem with the first impeller and a key is inserted between the stud and the two impellers thus operatively locking the impellers to the drive shaft.

BRIEF DESCRIPTION OF THE DRAWING

For a better understanding of the present invention, as well as other objects and further features thereof, reference is had to the following detailed description of the invention to be read in connection with the accompanying drawing illustrating a shaft and impeller assembly embodying the teachings of the present invention.

DESCRIPTION OF THE PREFERRED EMBODIMENT

The machine generally referenced 10, illustrated in the drawing, is basically a multi-stage overhung centrifugal compressor consisting of a stationary base frame 11 for housing the machine drive and two compressor sections 12 and 13 suspended from the base frame upon two end plates 14 and 15 secured to the base frame structure as by bolting or welding. A main drive gear 17 is supported within the base frame and is driven by suitable means known and used in the art such as an electrical motor, turbine, combustion engine, or the like. A pinion shaft 20 is also journaled within the base frame upon bearings 21, 22 with the centrally located pinion gear 25 being mated with the driving gear 17. The body 26 of the pinion shaft is arranged to extend outwardly through a shaft opening 27 formed in the base frame and the two end plates so that the two ends of the shaft pass into the compressor sections 12 and 13. Positioned outboard of the two shaft bearings are a pair of shaft seal assemblies 29, 30. Each assembly supports a plurality of bushings which serve to prevent the working fluids contained within the compressor sections from moving into the drive section or oil vapors from moving from the drive into the compressor section.

As shown in the drawing, a first stage impeller 32 is supported within compressor section 12 hung upon the lefthand end plate 14. In assembly, the impeller is slidably mounted upon an elongated stud 33 that is threaded into the end face 35 of the shaft in axial alignment therewith. The hub of the impeller is provided with an axially extended shoulder 37 that is press fitted into a complementary opening 38 formed in the end face of the impeller shaft. The shoulder serves to prevent radial shifting of the impeller and also facilitates seating of the impeller against the end face of the shaft to reduce fretting under operational loads.

A key 40 is positioned in engagement with the shaft 26 and the stud 33 to insure that the members rotate in unison. The key is further elongated to extend beyond the end face of the shaft to securely engage the hub of the impeller thus locking the impeller to both the stud and the shaft. A lock nut 42, arranged to act against a recessed washer 43, is threaded upon the free end of the stud; the nut acting to force the impeller into seating contact against the end face of the shaft and to prevent axial shifting of the impeller upon the stud.

Referring now to the opposite end of the shaft, there is shown a second embodiment of the present invention wherein two impellers are supported in tandem upon the pinion shaft. In this particular arrangement, an outboard impeller 53, making up part of the second compressor stage, and an inboard impeller 54, making up part of the third compressor stage, are both supported upon a common elongated stud 55 threaded into the end of the shaft in the same manner as described above. As previously noted, the inboard impeller 54 is secured to the shaft by press fitting extended shoulder 57 into recess 58 and keying the impeller to both the stud 55 and the shaft by means of a common key 59.

As illustrated, the backside of the second stage impeller abuts against the end of the extended hub of the third stage impeller. Here again, the second stage impeller is provided with an extended shoulder 68 which is press fitted into a recess 69 formed within the hub 60 of the third stage impeller. A second key 65 is carried within the stud and engages both impeller hubs thus locking the two impellers to the stud for rotation therewith. To reduce stresses in the stud and to facilitate balancing of the assembly, the two keys 59 and 65 are offset 180° in assembly. The entire two impeller assembly is secured against axial movement by means of lock nut 70 threaded to the free end of stud 55 which, acting through recessed washer 71, forces the third stage impeller into seating contact with end face 72 of the shaft and the second stage impeller into seating contact against the extended hub of the third stage impeller.

As can be seen, the assembly herein described permits the individual impellers to be conveniently mounted or rearranged upon the shaft without having to remove the shaft from the base frame. To assemble an impeller upon the shaft, a stud of predetermined length is threaded into the shaft and the two keyed together. The key is elongated and extends beyond the end face of the shaft. Next, the impeller is moved onto the stud and the key aligned with a key slot formed in the impeller hub. The impeller is then press fitted into the shaft which in turn seats the key in the slot. Finally, the lock nut is secured to the end of the shaft and tightened down thus securing the entire assembly in place. In the case where more than one impeller is mounted upon a common stud, the first impeller is secured as described above. However, before securing the lock nut to the stud, a second elongated key is inserted between the first impeller hub and the stud and the second impeller is press fitted into the first impeller as disclosed thus seating the key in the second impeller hub. In this arrangement, the two impellers, the shaft, and the stud are all cojoined for rotation.

Although the present invention is described in reference to a base frame machine utilizing three stages of compression, it should also be clear from the disclosure that the impeller mounting structure herein disclosed can be utilized to mount any number of impellers upon a common shaft and that the order of arrangement can be altered without departing from the present invention. Accordingly, the present mounting structure, when used in a modular base frame machine, provides for ease of interchangeability between components and considerably reduces the number of modular parts that are required to construct machines of different capacity from a single base frame.

While this invention has been described with reference to the structure herein disclosed, it is not confined to the details as set forth, and this application is intended to cover any modifications or changes as may come within the scope of the following claims.

What we claim is:

1. A rotor assembly for use in an overhung rotary machine wherein the rotor components are cantilevered from the end of a shaft including a drive shaft operatively connected to the machine drive and rotatably supported in a base frame with at least one end of the shaft extending outwardly beyond said frame, the extended end face of the shaft having an aperture formed therein, a stud secured to the shaft and extending outwardly beyond the end face thereof in axial alignment with the shaft, a rotor member slidably mounted upon the stud having an axially extended shoulder thereon which is press fitted into the aperture formed within the end face of the shaft to support the rotor member in axial alignment with the stud and the shaft, and a key positioned to engage the shaft, the stud and the rotor member.

2. The assembly of claim 1 having further locking means engaging the free end of the stud to prevent axial movement of the rotor member.

3. Apparatus for supporting a series of rotor elements upon a shaft including a drive shaft operatively connected to a drive means and being rotatably supported in a frame with at least one end of the shaft extending outwardly beyond said frame, the end face of said extended portion of the shaft having an aperture formed therein, an elongated stud being secured within the shaft in coaxial alignment therewith extending outwardly from said end face, a first impeller slidably mounted upon said stud having a shoulder thereon which is press fitted into the aperture formed in the end face of the shaft, a first key engaging the shaft, the stud and the first impeller, a second impeller slidably mounted upon said shaft in contiguous relation with the first impeller having an extended shoulder press fitted into a receiving aperture formed in said first impeller, and a second key engaging the stud and said first and second impellers.

4. The apparatus of claim 3 further including securing means operatively associated with the free end of the stud to prevent axial movement of said impellers.

5. The apparatus of claim 4 wherein said stud is threaded into said shaft.

6. The apparatus of claim 4 wherein said first and said second keys are offset 180° in relation to the stud.

* * * * *